US008929048B2

(12) United States Patent
Smugala et al.

(10) Patent No.: US 8,929,048 B2
(45) Date of Patent: Jan. 6, 2015

(54) VERY FAST TRANSIENT SUPPRESSING DEVICE

(75) Inventors: Dariusz Smugala, Tomaszow Mazowiecki (PL); Wojciech Piasecki, Cracow (PL); Grzegorz Bywalec, Oswiecim (PL); Magdalena Ostrogorska, Cracow (PL); Ole Granhaug, Skien (NO); Pal Skryten, Skien (NO)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/696,351

(22) PCT Filed: May 16, 2011

(86) PCT No.: PCT/EP2011/002523
§ 371 (c)(1), (2), (4) Date: Nov. 6, 2012

(87) PCT Pub. No.: WO2011/147552
PCT Pub. Date: Dec. 1, 2011

(65) Prior Publication Data

US 2013/0063855 A1 Mar. 14, 2013

(30) Foreign Application Priority Data

May 24, 2010 (EP) ..... 10460018

(51) Int. Cl.
*H01C 7/12* (2006.01)
*H01H 33/16* (2006.01)
*H01F 17/06* (2006.01)

(52) U.S. Cl.
CPC ..... *H01H 33/165* (2013.01); *H01F 17/062* (2013.01); *H01F 2017/065* (2013.01)
USPC ..... 361/117; 361/119

(58) Field of Classification Search
USPC ..... 361/117–120
See application file for complete search history.

(56) References Cited

U.S. PATENT DOCUMENTS 5,721,664 A * 2/1998 Uken et al. ..... 361/125
6,218,913 B1 4/2001 Pagenkopf ..... 333/181

(Continued)

FOREIGN PATENT DOCUMENTS

GB 1187410 4/1970 ..... H01H 33/16
WO WO 2008/040128 A1 4/2008 ..... H02H 9/04

OTHER PUBLICATIONS

International Search Report in corresponding PCT Application No. PCT/EP2011/002523 mailed Nov. 15, 2011.

(Continued)

*Primary Examiner* — Danny Nguyen
(74) *Attorney, Agent, or Firm* — Renner Kenner Greive Bobak Taylor & Weber

(57) ABSTRACT

A device for suppressing very fast transients, applicable in protecting electric and/or electric power equipment, and especially transformers operating in electric power substations and in wind power plants, connected in a supply network circuit downstream of a circuit breaker and upstream of the protected equipment is disclosed. The device is a component of an induction character, comprising a high-frequency magnetic core arranged around the current-conducting lead. On the magnetic core is wound at least one winding with at least one pair of terminals used for connecting at least one damping resistor. The inventive device contains an insulating body in which there is a magnetic core, a damping resistor and a winding, or an insulating body in which there is a magnetic core together with a damping resistor, a winding and a section of a current-conducting lead.

8 Claims, 6 Drawing Sheets

(56) References Cited

U.S. PATENT DOCUMENTS

| | | | | |
|---|---|---|---|---|
| 6,642,806 | B1 | 11/2003 | Glinkowski et al. | 333/12 |
| 7,005,943 | B2 * | 2/2006 | Cern | 333/175 |
| 2003/0205295 | A1 * | 11/2003 | Yoshida et al. | 148/108 |
| 2007/0178850 | A1 * | 8/2007 | Sandahl et al. | 455/84 |

OTHER PUBLICATIONS

Written Opinion in corresponding PCT Application No. PCT/EP2011/002523 mailed Nov. 15, 2011.

* cited by examiner

VERY FAST TRANSIENT SUPPRESSING DEVICE

CROSS-REFERENCE TO RELATED APPLICATION

This is a §371 application of International patent application number PCT/EP2011/002523 filed May 16, 2011, which claims the benefit of European patent application number 10460018.4 filed on May 24, 2010, both of which are incorporated herein by reference.

The subject of the invention is a device for suppressing very fast transients, applicable in protecting electric and/or electric power equipment, and especially transformers operating in electric power substations and in wind power plants, connected in the supply network circuit downstream of the circuit breaker and upstream of the protected equipment.

BACKGROUND ART

During the operation of electric power equipment in electric power substations and in switchgears that contain vacuum circuit breakers, in the course of the operation of switching the circuit breakers on and off, electric power equipment is exposed to very fast transients which are dangerous to the operated equipment. By way of example, very fast transients are generated when transformers are switched on or off by means of vacuum circuit breakers. Transformers are often connected with circuit breakers by means of cables of a length of several dozen or several hundred meters. Low value of impedance and insignificant cable loss cause that the amplitude of the generated very fast transients magnified by wave reflections at the connection points, which can considerably exceed the rated value of the supply voltage, and the frequency of such transients can range from a few hundred kHz to as much as a few MHz. Then very fast transients can damage the transformer insulation or its windings. A voltage of a short risetime of a few dozen or a few hundred kV/ps and oscillations of frequencies ranging from several hundred kHz to many MHz that accumulate on the transformer winding degrade the insulation and, in consequence, lead to its breakdown and internal faults. Therefore there is a need to eliminate or reduce the damaging effect of very fast transients by using an additional protective component or device. Typically, varistor surge arrester, surge capacitors of capacitances in the order of a few hundred nF, RC filters and pre-insertion resistors, connected in parallel with the circuit breaker contacts are used as additional components or devices against the damaging occurrence of very fast transients.

The use of varistor surge arresters ensures great efficiency of transient amplitude reduction, but it does not change the rate of rise of the voltage wave. Moreover, due to the character of operation of this type of suppressors, additional high-frequency voltage components are generated.

Solutions based on surge capacitors characterized by large capacitance value and R-C filters are efficient, but these have large dimensions and weights which make placing them in a common housing with the protected device or circuit breaker fairly difficult. In addition, although R-C filters provide good protection against large amplitude interference, the rate of rise of the first voltage wave is in many cases not reduced, which significantly affects the level of protection of the protected facilities. It takes place particularly when the connection between the breaker and the protected equipment is relatively short. Then, pre-insertion resistances connected in parallel with the system of the circuit breaker contacts are difficult to install and they require additional contacts. Moreover, the large power emitted on such a resistor and problems connected with its dissipating are by no means insignificant.

Another solution used to reduce very fast transients are devices in the form of R-L reactors connected in series and having specially selected parameters. They act as a conductor of minute resistance for the low frequencies of the applied voltage and as an additional series impedance for higher frequencies that occur during connection phenomena. These devises are characterized by low voltage drop on their own impedance and by a small value of power dissipated during operation in stable condition. However, although these devices are very effective in suppressing very fast transients, they have a certain inconvenient feature, namely their dimensions depend on the value of current flowing through these devices, and the significant power dissipated during the flow of large-value fault current can result in their thermal destruction. The above mentioned inconveniences prevent the use of this type of solutions for installation in switchgears located in electric power substations connected with wind power plants by means of power cables.

All the presented solutions either fail to ensure full protection, as is the case of varistor transient suppressors, or the presence of these devices in the power network during normal operating conditions, for the operating frequency of 50/60 Hz, causes the dissipation of additional power in these devices. For that reason, the presented solutions are not acceptable as devices that fully protect transformers working in power substations or in wind power plants. The inconvenient integration of such devices with switchgears and wind power plants prevents their use in such cases due to the limited space available in the nacelle gondola or in the tower of a wind generator.

Patent description U.S. Pat. No. 6,642,806 reveals a method that allows a reduction in the frequency of occurrence of transients and/or in the amplitude value, which consists in placing a magnetic core of high magnetic permeability around a lead that conducts electric current. The use of the magnetic core allows to reduce the dimensions of the device which protects equipment against transients. If the device according to the presented solution is used, the efficiency can be insufficient due to the limited efficiency of the suppression of potential oscillations of transients only by the lossiness of the magnetic material of the core.

An additional disadvantage of this type of solution is the saturation of the core and thereby loss of the functionality of the device before the process of generation of very fast transients ends.

Patent description WO 2008/040128 reveals a method which allows to reduce the values of very fast transients, based on cores of a magnetic material arranged around a piece of a current-conducting lead and a resistor that shunts the piece of the current-conducting lead. An inconvenience of this solution is the need to make a galvanic connection between the shunting resistor and the current path, which requires a considerable modification of the current path.

Patent description of GB1187410 reveals an arrangement counteracting voltage surges due to circuit breaker interruption. In the arrangement electrically conducting lead is connecting with an interrupting contact of the circuit breaker. The conducting lead is encircled by a separate core of ferromagnetic material and in combination with the core is constituting a high frequency inductance device series connected with the interrupting contact. The core carries a secondary winding across which a resistor is connected.

SUMMARY OF THE INVENTION

The essence of the device for suppressing very fast transients occurring in current-conducting leads, which is a component of an induction character and which contains a high frequency magnetic core arranged around a current-conducting lead and on the magnetic core there is wound at least one winding with at least one pair of terminals used to connect at least one suppressing resistor, is that it contains an insulating body comprising a magnetic core with a damping resistor and a winding or contains an insulating body comprising a magnetic core with a damping resistor, a winding and a section of a current-conducting lead.

The device in its second embodiment is the insulating bushing of a medium voltage distribution board.

The magnetic core is alternatively made of an amorphous tape.

The magnetic core is alternatively made of a powder material.

The advantage of the inventive device is its ability to effectively suppress the highest frequencies of very fast processes, ranging from a few hundred kHZ to a few MHz, that can occur during switching operations using vacuum circuit breakers, because its impedance depends on the operating frequency and this impedance increases with the increase in frequency. A single-turn primary winding is a current path, therefore it is possible to construct a device having small dimensions. Thanks to the small dimensions of the inventive device it can be used for protecting transformers that operate in wind power plant, because this device as well as the inventive bushing can be located in switchgears and/or power substations distant from the location of the transformer. The inventive bushing is characterized by small dimensions even for large values of the current flowing through this bushing. The bushing has a simple design and is handy in use. It can be used as additional equipment of existing switchgears and/or power substations, and its use does not require magnificent modifications. The introduction of an additional resistor or resistors considerably increases the effectiveness of suppression of transients and makes it possible to control the level of saturation of the core of the protective device.

BRIEF DESCRIPTION OF THE DRAWINGS

The inventive device is presented as an embodiment in the drawing where.

BEST MODE FOR CARRYING OUT THE INVENTION

Figure 1:
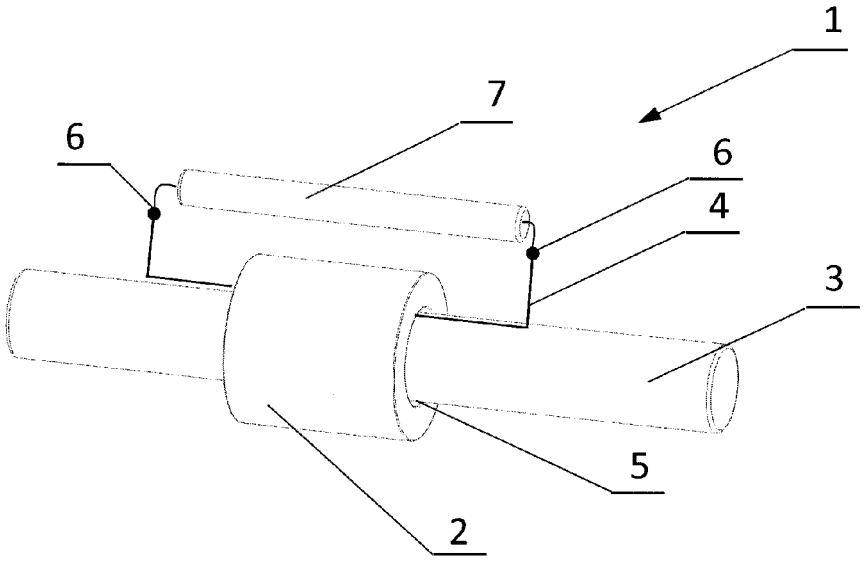
FIG. 1 shows the device with the winding in the form of a single-turn coil with a resistor in a perspective view, FIG. 2—the device with the winding in the form of multiple single-turn coils with resistors, in a perspective view, FIG. 3—the device with the winding in the form of sections of the winding between which damping resistors are connected in series in such way that the damping resistors together with the winding segments form a closed electric circuit, in a perspective view, FIG. 4—a cable termination with the inventive device for suppressing very fast transients, in longitudinal section, FIG. 5—the inventive bushing with the device for suppressing very fast transients, in longitudinal section, FIG. 6—a magnetic core suitable for use in a cable connection, in longitudinal section, FIG. 7—a magnetic core made as a set of cores situated in series in relation to one another, in a perspective projection, FIG. 8—a magnetic core made as a set of cores situated concentrically in relation to one another, in a perspective projection, FIG. 9—the use of the inventive device as an accessory of a cable connection, and FIG. 10—the use of the device as an accessory of a cable termination.

The inventive device 1 comprises a high-frequency magnetic core 2 arranged around a current-conducting lead 3 and a closed winding circuit 4. In the presented embodiment the magnetic core 2 is made in the form of a ring with a port 5. In operating conditions the magnetic core 2 can have a different shape and its cross-section in a plane parallel to the port 5 can have the form, for instance, of a square, oval or triangular framing, which is not shown in the drawing. The current-conducting lead 3 which is located in the port 5 of the magnetic core, is the primary winding. A winding 4 together with a damping resistor or resistors form a closed electric circuit. The winding 4 is formed by at least one conducting coil furnished with at least one pair of terminals 6, into which a damping resistor 7 of suppressing resistance ensuring effective reduction or suppression of very fast transients for a given application is connected. The magnetic core 2 is made of magnetic material of high magnetic permeability, preferably of a nanocrystalline material, and in the simplest embodiment of the invention it is a single ring. In another embodiment, the magnetic core 2*a* is a ring with a port 5 whose diameter is adjusted to the shape of the component containing the current-conducting lead 3. In still another embodiment, the magnetic core 2*b* consists of a set of many rings arranged in series in relation to one another. In still another embodiment the magnetic core 2*c* is formed by at least two rings situated concentrically in relation to each other.

The device 1 comprises the winding 4 which is a single coil with at least one resistor 7. This coil is wound on the magnetic core 2.

Figure 2:
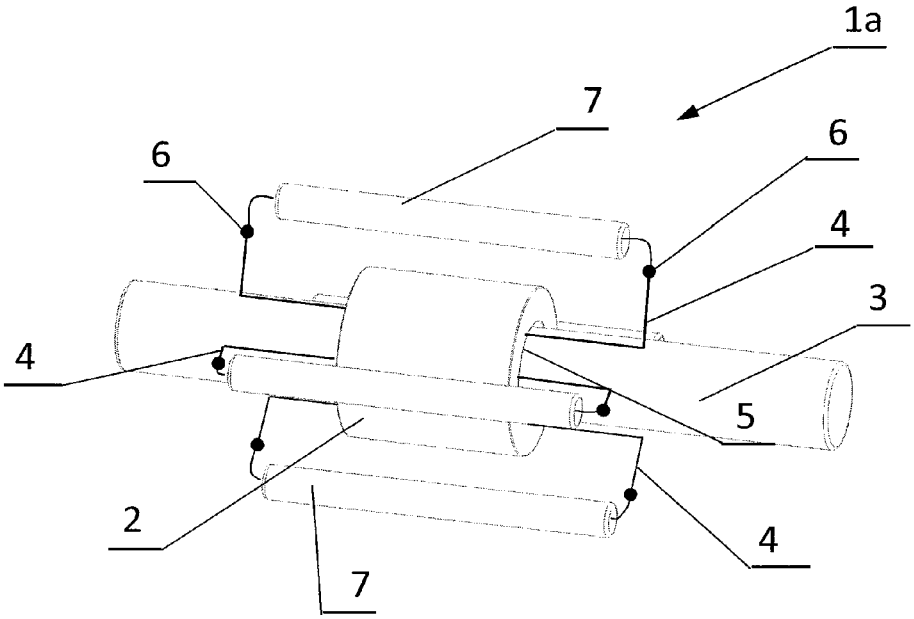
Figure 3:
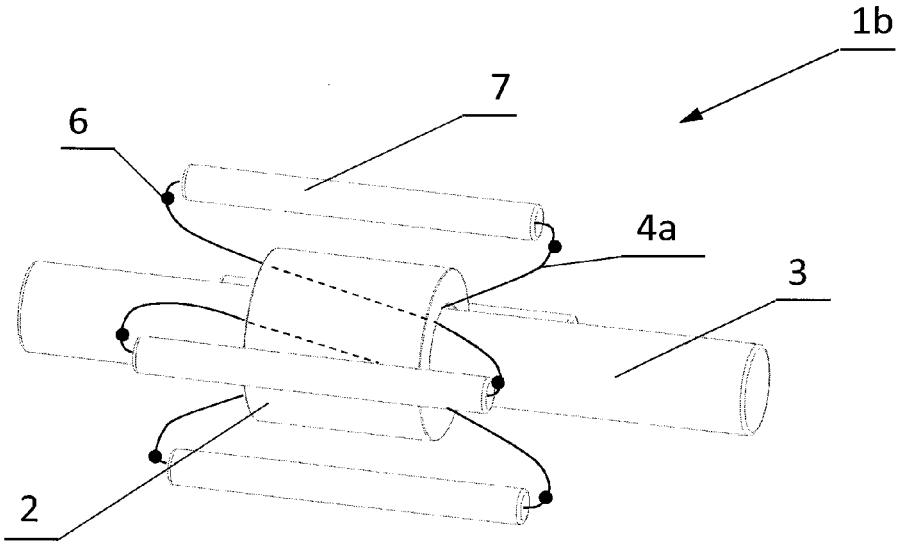
Figure 4:
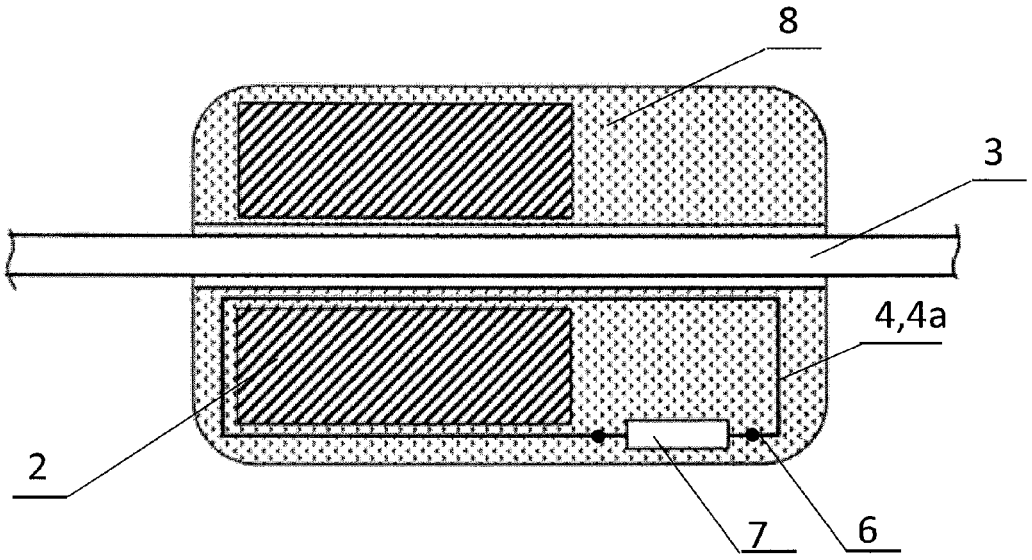

In another embodiment of the invention, the device 1*a*, shown in FIG. 2, contains many windings 4 with resistors 7 connected to their terminals 6. In still another embodiment of the example, the device 1*b*, shown in FIG. 3, contains the winding 4*a* which is made in the form of sections between which suppressing resistors 7 are connected in series in such way that together with the sections of the winding 4*a* they form a closed electric circuit.

In the operating conditions of the invention, the number of the resistors 7 depends on their rated power and their ability to dissipate power that is emitted on them.

The inventive device, made in any form, is placed in an insulating body 8, 8*a* using known processes of molding with thermosetting materials, and especially molding with epoxy, polyurethane resin, or silicone filling compound.

Figure 5:
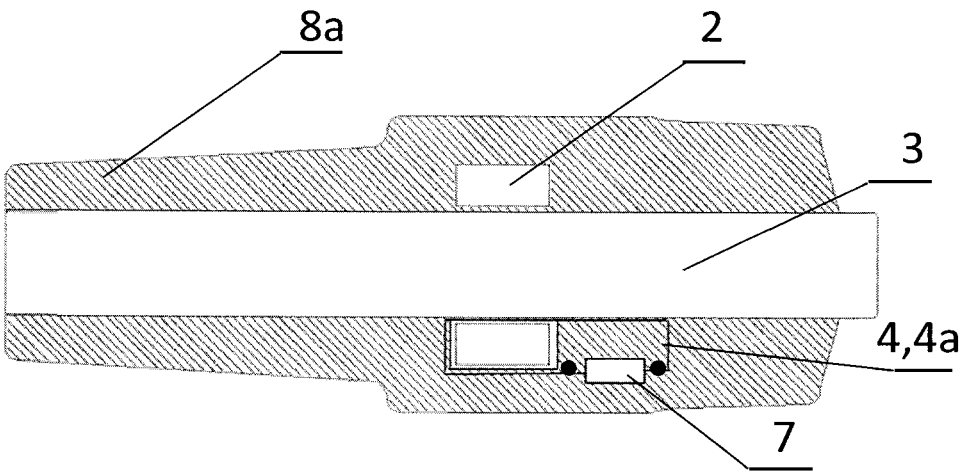
Figure 6:
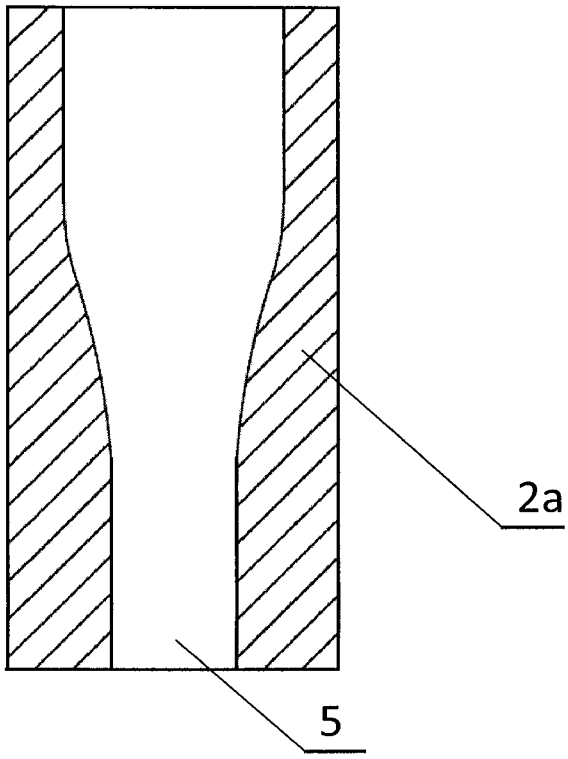
Figure 7:
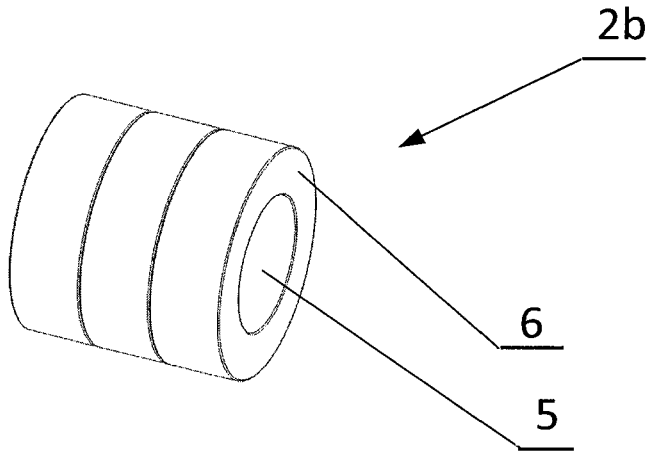
Figure 8:
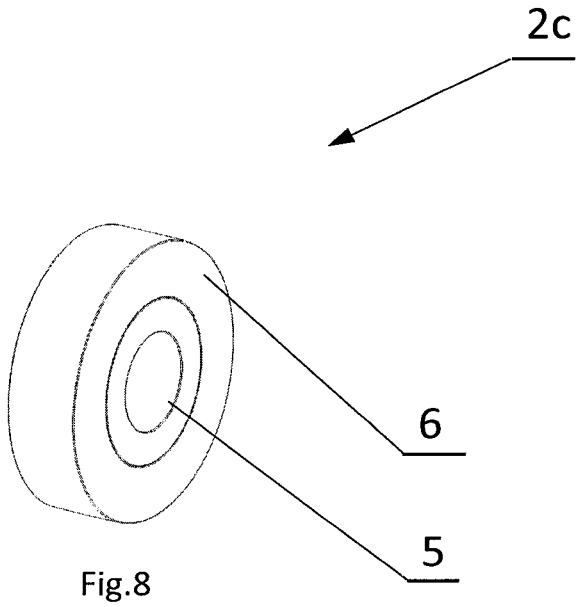

The body 8*a* together with the core and the winding circuit or circuits with the resistors and a section of the current-conducting lead in the form of a rod or a section of a cable is a finished technological product in the form of an insulating bushing, as shown in FIG. 5. The bushing produced in this way is applicable in various electric power equipment to the reduction of the damaging effect of very fast transients, and it is connected to a switchgear downstream of the circuit breaker and upstream of the protected equipment.

Figure 9:
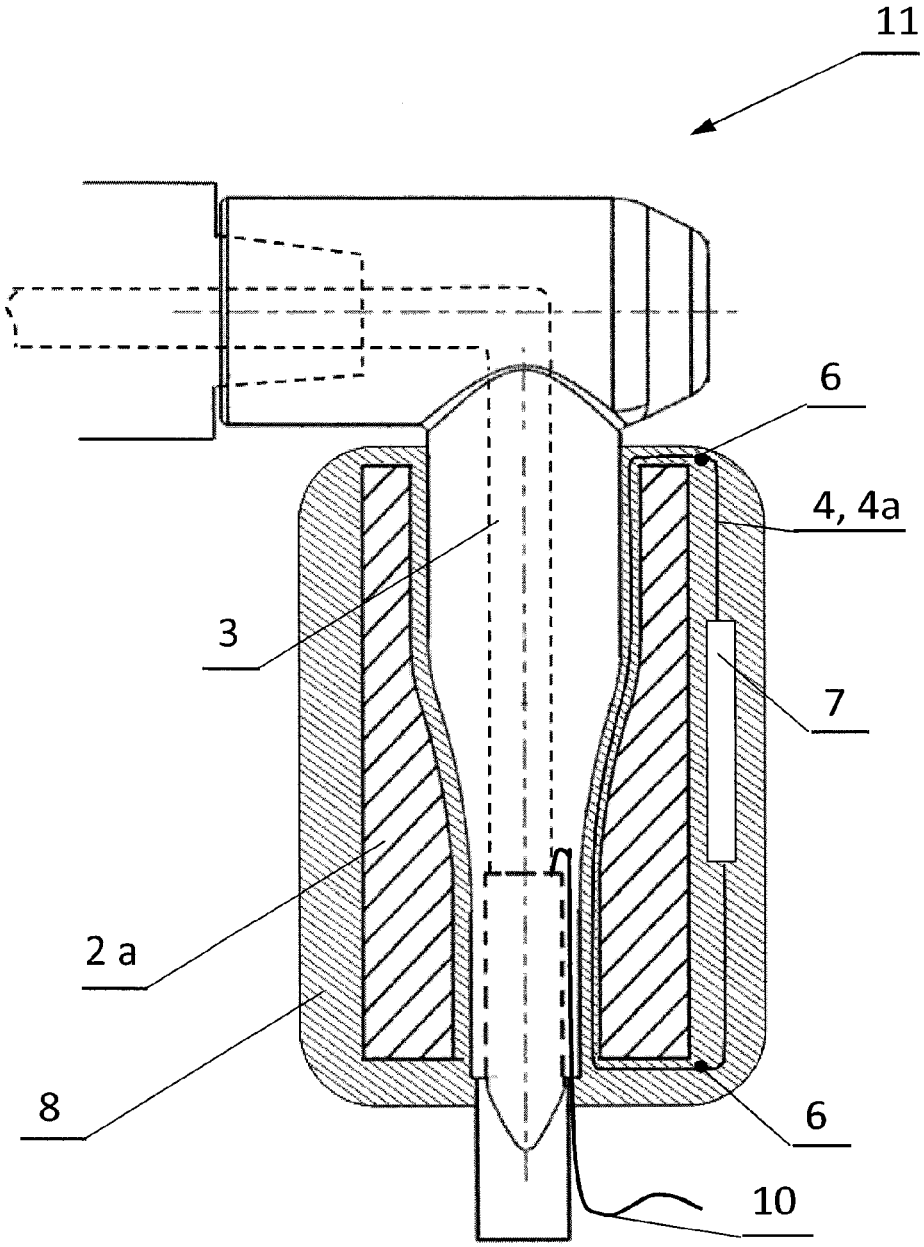
Figure 10:
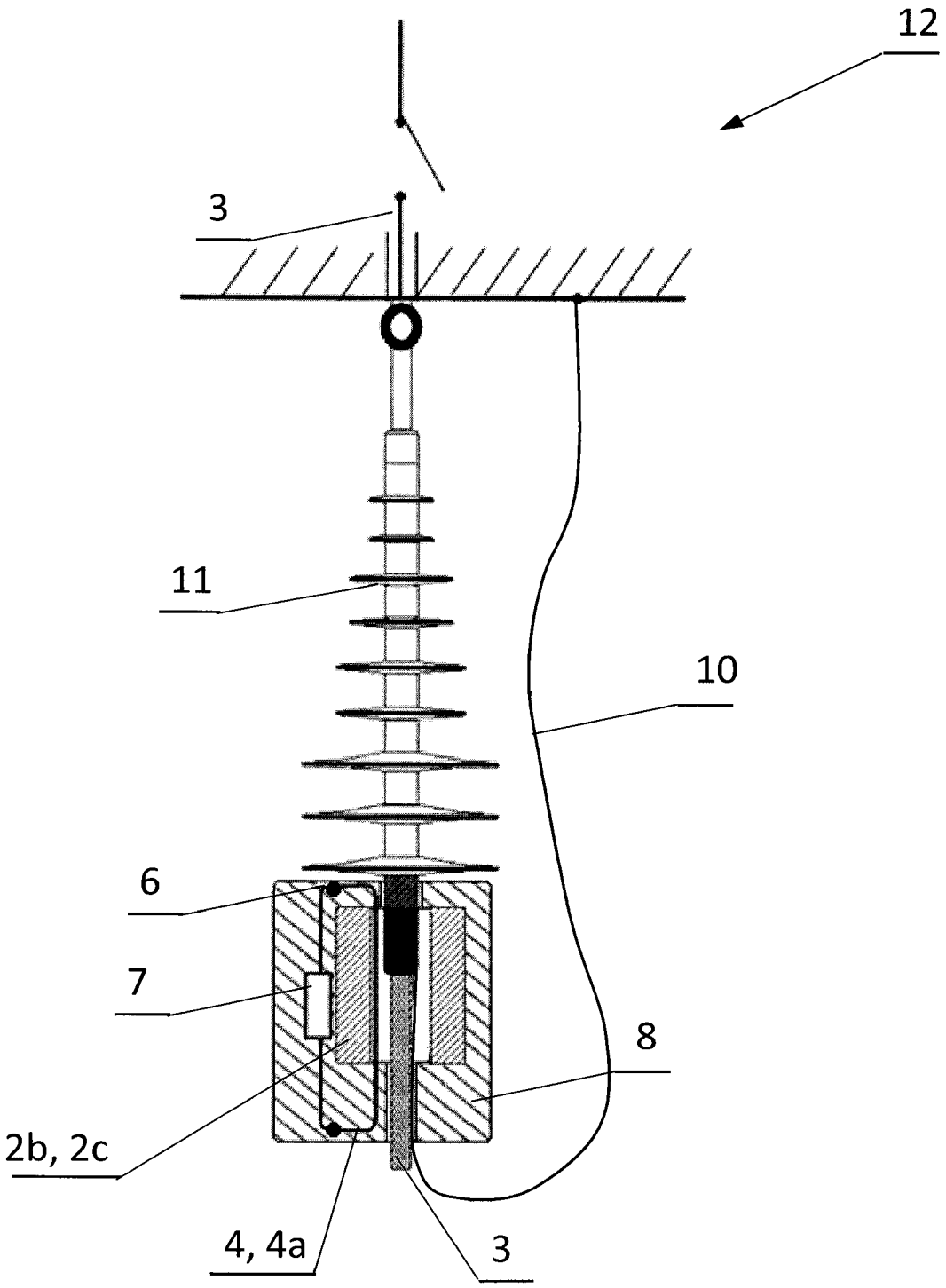

The body 8 together with the core and the winding circuit or circuits with the resistors has a port 9, which allows to put the whole body 8 together with the inventive device onto a piece of a cable termination 12 or on a piece of a cable connection 11 inside which there is the current-conducting lead 3, as shown in FIGS. 9 and 10 respectively. Additionally, a load 10 is connected to the cable screen in order to provide cable screen grounding. The device produced in this way is applicable as the an accessory of a cable termination in various types of electric power equipment, to the reduction of the damaging effect of very fast transients, and it is connected to a switchgear downstream of the circuit breaker and upstream of the protected equipment.

In operating conditions, the impedance of the VFT suppressing device for the operating frequency of 50/60 Hz is negligible. It increases with the increase in the frequency of the applied voltage. For very large frequencies its value approaches the value resulting from the value of the resistance connected to the winding, converted to the side of the single-turn primary winding formed by the current-conducting lead. The larger the inductance of the device 1, 1*a*, 1*b* that contains a magnetic core or cores, the lower the frequency for which the resultant impedance approaches the limit value determined by the resistance of the suppressing resistors. Therefore it is beneficial to use a magnetic core in the device, which makes it possible to obtain a suitably large inductance for the single-turn coil formed by the current-conducting lead. Due to the fact that the impedance of the device for high frequencies has a resistive character and that it is connected in series between the source of transients that have large rates of rise whose source is the vacuum circuit breaker and the protected device, it is possible to obtain a considerable reduction in the rate of rise in voltage on the terminals of the protected device whose capacitance to earth and the cable capacitance, in case of the cable connection, together with the impedance of the VFT suppressing device form a low pass filter. The use of a resistor connected to the winding wound on a magnetic core eliminates the need to galvanically connect the resistor to the current-conducting lead. The value of the resistance of the suppressing resistor should be selected to obtain the maximum reduction in the rate of rise of voltage on the terminals of the protected piece of equipment, and at the same time to avoid oscillating transients in the circuit created by the inductance of the suppressing device and the capacitance of the protected equipment. Therefore, the selection of the resistance of the suppressing resistor must be done for the specific material and size of the magnetic core that is used, and for the capacitance of the protected equipment. Such selection with a view to meeting the above mentioned criteria is within the scope of electrical engineering expertise and skills.

The invention claimed is:

1. A device for suppressing very fast transients in a current conducting lead, comprising:

a current conducting lead;

a high-frequency magnetic core adapted to be arranged around the current-conducting lead;

at least one winding with at least one pair of terminals wrapped around said high-frequency magnetic core; and at least one damping resistor connected only between said at least one pair of terminals so as to form a closed electric circuit which is not galvanically connected to said current conducting lead.

2. The device according to claim 1, further comprising:

an insulating body enclosing said high-frequency magnetic core, said at least one winding and said at least one damping resistor.

3. The device according to claim 1, further comprising:

an insulating body enclosing said high-frequency magnetic core, said at least one winding, said at least one damping resistor and a section of said current conducting lead.

4. The device according to claim 1, wherein the device is an insulating bushing of a medium voltage switchgear.

5. The device according to claim 1, wherein said high-frequency magnetic core is made of amorphous tape.

6. The device according to claim 1, wherein said high-frequency magnetic core is made of powder material.

7. The device according to claim 1, wherein said molded insulating body is made from thermosetting material.

8. The device according to claim 7, wherein said thermosetting material is selected from the group consisting of epoxy, polyurethane resin and silicone filling compound.

* * * * *